US007698755B2

(12) United States Patent
McNerney et al.

(10) Patent No.: US 7,698,755 B2
(45) Date of Patent: Apr. 20, 2010

(54) OVERHEAD CAM FAUCET MOUNTING SYSTEM

(75) Inventors: Gerald J. McNerney, Noblesville, IN (US); Scott K. Jones, Westfield, IN (US)

(73) Assignee: Masco Corporation of Indiana, Indianapolis, IN (US)

( * ) Notice: Subject to any disclaimer, the term of this patent is extended or adjusted under 35 U.S.C. 154(b) by 1269 days.

(21) Appl. No.: 11/214,241

(22) Filed: Aug. 29, 2005

(65) Prior Publication Data

US 2007/0044232 A1 Mar. 1, 2007

(51) Int. Cl.
*E03C 1/042* (2006.01)

(52) U.S. Cl. ..... 4/695

(58) Field of Classification Search ..... 4/619, 4/624, 626, 671–673, 675–678, 695
See application file for complete search history.

(56) References Cited

U.S. PATENT DOCUMENTS

| | | | |
|---|---|---|---|
| 1,592,353 | A | 7/1926 | Gade |
| 2,173,064 | A | 9/1939 | Judell |
| 2,591,991 | A | 4/1952 | Young |
| 2,848,721 | A | 8/1958 | Fredrickson |
| 3,010,474 | A | 11/1961 | Moen |
| 3,012,251 | A | 12/1961 | Fife |
| 3,035,276 | A | 5/1962 | Hanson |
| 3,155,115 | A | 11/1964 | Ziegler |
| 3,229,710 | A | 1/1966 | Keller, III |
| 3,427,049 | A | 2/1969 | Politz |
| 3,448,768 | A | 6/1969 | Keller, III |
| 3,495,616 | A | 2/1970 | Esposito |
| 3,561,485 | A | 2/1971 | Kingler |
| 3,600,723 | A | 8/1971 | Mongerson et al. |
| 3,609,774 | A | 10/1971 | Allgood |
| 3,645,493 | A | 2/1972 | Manoogian et al. |
| 3,790,966 | A | 2/1974 | Keane |
| 3,796,380 | A | 3/1974 | Johnson et al. |
| 3,807,453 | A | 4/1974 | Dom et al. |
| 3,911,946 | A | 10/1975 | Humpert et al. |
| 3,998,240 | A | 12/1976 | Liautaud |
| 4,026,328 | A | 5/1977 | Nelson |
| 4,064,900 | A | 12/1977 | Schmitt |
| 4,186,761 | A | 2/1980 | Guarnieri |
| RE30,559 | E | 3/1981 | Schmitt |
| 4,290,445 | A | 9/1981 | Turner |
| 4,328,830 | A | 5/1982 | Greer |
| 4,337,795 | A | 7/1982 | Argyris et al. |
| 4,356,574 | A | 11/1982 | Johnson |
| 4,387,738 | A | 6/1983 | Bisonaya et al. |
| 4,446,885 | A | 5/1984 | Nolden |

(Continued)

FOREIGN PATENT DOCUMENTS

| | | |
|---|---|---|
| CH | 245633 | 11/1947 |
| CH | 275914 | 6/1951 |
| CN | 1278584 | 1/2001 |
| CN | 1278585 | 1/2001 |
| CN | 1278586 | 1/2001 |

(Continued)

*Primary Examiner*—Huyen Le
(74) *Attorney, Agent, or Firm*—Baker & Daniels LLP

(57) ABSTRACT

A faucet assembly including a mounting base, an upper faucet assembly, and a cam fastener. The mounting base is configured to be coupled to a mounting deck and includes first and second inlet water conduits. The cam fastener is rotatably coupled to the mounting base and the upper faucet assembly to releasably couple the upper faucet assembly to the mounting base.

28 Claims, 12 Drawing Sheets

U.S. PATENT DOCUMENTS

| | | | | |
|---|---|---|---|---|
| 4,458,839 | A | | 7/1984 | MacDonald |
| 4,513,769 | A | | 4/1985 | Purcell |
| 4,552,171 | A | | 11/1985 | Farrell et al. |
| 4,635,673 | A | | 1/1987 | Gerdes |
| 4,649,958 | A | | 3/1987 | Purcell |
| 4,671,316 | A | | 6/1987 | Botnick |
| 4,678,002 | A | | 7/1987 | Valley |
| 4,700,928 | A | | 10/1987 | Marty |
| 4,706,702 | A | | 11/1987 | Grasseschi |
| 4,760,861 | A | | 8/1988 | Botnick |
| 4,762,143 | A | | 8/1988 | Botnick |
| 4,762,273 | A | | 8/1988 | Gregory et al. |
| 4,771,485 | A | | 9/1988 | Traylor |
| 4,827,538 | A | | 5/1989 | Heimann et al. |
| 4,848,395 | A | | 7/1989 | Krippendorf |
| 4,852,192 | A | | 8/1989 | Viegener |
| 4,856,121 | A | | 8/1989 | Traylor |
| 4,903,725 | A | | 2/1990 | Ko |
| 4,911,335 | A | | 3/1990 | Stofle et al. |
| 4,966,186 | A | | 10/1990 | Rodstein |
| 4,998,555 | A | | 3/1991 | Barhydt, Sr. et al. |
| 5,010,922 | A | | 4/1991 | Agresta |
| 5,020,569 | A | | 6/1991 | Agresta |
| 5,027,851 | A | | 7/1991 | Drees et al. |
| 5,073,991 | A | | 12/1991 | Marty |
| 5,090,062 | A | | 2/1992 | Hochstrasser |
| 5,095,554 | A | | 3/1992 | Gloor |
| 5,127,427 | A | | 7/1992 | Kajpust et al. |
| 5,127,438 | A | | 7/1992 | Williams |
| 5,131,428 | A | | 7/1992 | Bory |
| 5,148,832 | A | | 9/1992 | Lin |
| 5,165,121 | A | | 11/1992 | McTargett et al. |
| 5,232,008 | A | | 8/1993 | Jeffress et al. |
| 5,275,199 | A | | 1/1994 | Howell |
| 5,349,987 | A | | 9/1994 | Shieh |
| 5,361,431 | A | | 11/1994 | Freier et al. |
| 5,375,272 | A | | 12/1994 | Mikol |
| 5,388,287 | A | | 2/1995 | Tischler et al. |
| 5,465,749 | A | | 11/1995 | Sauter et al. |
| 5,465,749 | A | | 11/1995 | Sauter et al. |
| 5,467,799 | A | | 11/1995 | Buccicone et al. |
| 5,515,882 | A | | 5/1996 | Hennis |
| 5,518,016 | A | | 5/1996 | Sharwark |
| 5,535,776 | A | | 7/1996 | Kingman |
| 5,558,128 | A | | 9/1996 | Pawelzik et al. |
| 5,566,707 | A | | 10/1996 | Ching et al. |
| 5,642,755 | A | | 7/1997 | Mark et al. |
| 5,660,203 | A | | 8/1997 | Gnauert et al. |
| 5,669,417 | A | | 9/1997 | Lian-Jie |
| 5,685,341 | A | | 11/1997 | Chrysler et al. |
| 5,687,952 | A | | 11/1997 | Arnold et al. |
| 5,725,008 | A | | 3/1998 | Johnson |
| 5,746,244 | A | | 5/1998 | Woolley, Sr. et al. |
| 5,758,688 | A | | 6/1998 | Hamanaka et al. |
| 5,797,151 | A | | 8/1998 | Ko |
| 5,803,120 | A | | 9/1998 | Bertoli |
| 5,813,431 | A | | 9/1998 | Cool et al. |
| 5,822,811 | A | | 10/1998 | Ko |
| 5,845,345 | A | | 12/1998 | Ko |
| 5,865,211 | A | | 2/1999 | Thomas |
| 5,865,473 | A | | 2/1999 | Semchuck et al. |
| 5,884,662 | A | | 3/1999 | Ko |
| 5,894,613 | A | | 4/1999 | Fenn |
| 5,918,855 | A | | 7/1999 | Hamanaka et al. |
| 5,924,451 | A | | 7/1999 | Kuo |
| 5,946,746 | A | | 9/1999 | Bloom |
| 5,950,663 | A | | 9/1999 | Bloomfield |
| 5,960,490 | A | | 10/1999 | Pitsch |
| 5,979,489 | A | | 11/1999 | Pitsch |
| 5,983,917 | A | | 11/1999 | Thomas |
| 6,006,784 | A | | 12/1999 | Tsutsui et al. |
| 6,014,985 | A | | 1/2000 | Warshawsky |
| 6,023,796 | A | | 2/2000 | Pitsch |
| 6,062,251 | A | | 5/2000 | Pitsch |
| 6,073,972 | A | * | 6/2000 | Rivera ..... 285/64 |
| 6,082,407 | A | | 7/2000 | Paterson et al. |
| 6,085,784 | A | | 7/2000 | Bloom et al. |
| 6,123,106 | A | | 9/2000 | Benstead |
| 6,125,875 | A | | 10/2000 | Dempsey et al. |
| 6,138,296 | A | * | 10/2000 | Baker ..... 4/678 |
| 6,161,230 | A | | 12/2000 | Pitsch |
| 6,170,098 | B1 | | 1/2001 | Pitsch |
| 6,189,569 | B1 | | 2/2001 | Calhoun |
| 6,195,818 | B1 | | 3/2001 | Rodstein et al. |
| 6,202,686 | B1 | | 3/2001 | Pitsch et al. |
| 6,202,980 | B1 | | 3/2001 | Vincent et al. |
| 6,209,153 | B1 | | 4/2001 | Segien, Jr. |
| 6,220,278 | B1 | | 4/2001 | Sauter et al. |
| 6,220,279 | B1 | | 4/2001 | Segien |
| 6,256,810 | B1 | | 7/2001 | Baker |
| 6,267,136 | B1 | | 7/2001 | Johnson |
| 6,273,138 | B1 | | 8/2001 | Yoney |
| 6,273,394 | B1 | | 8/2001 | Vincent et al. |
| 6,301,728 | B1 | | 10/2001 | Pilatowicz et al. |
| 6,302,131 | B1 | | 10/2001 | Pitsch |
| 6,314,593 | B1 | | 11/2001 | Mantel |
| 6,328,059 | B1 | | 12/2001 | Testori et al. |
| 6,334,226 | B1 | | 1/2002 | Tokunaga et al. |
| 6,360,770 | B1 | | 3/2002 | Buchner et al. |
| 6,360,774 | B1 | | 3/2002 | Becker et al. |
| 6,370,712 | B1 | | 4/2002 | Burns et al. |
| 6,378,912 | B1 | | 4/2002 | Condon et al. |
| 6,385,798 | B1 | | 5/2002 | Burns et al. |
| 6,405,749 | B1 | | 6/2002 | Bloom et al. |
| 6,421,849 | B1 | | 7/2002 | Gray |
| 6,422,520 | B1 | | 7/2002 | Hand |
| 6,434,765 | B1 | | 8/2002 | Burns et al. |
| 6,438,771 | B1 | | 8/2002 | Donath, Jr. et al. |
| 6,457,191 | B2 | | 10/2002 | Brandebusemeyer et al. |
| 6,484,330 | B2 | | 11/2002 | Gray et al. |
| 6,491,058 | B1 | | 12/2002 | Wang |
| 6,571,407 | B1 | | 6/2003 | Skarie |
| 6,619,320 | B2 | | 9/2003 | Parsons |
| 6,631,730 | B1 | | 10/2003 | Bloom et al. |
| 6,684,906 | B2 | | 2/2004 | Burns et al. |
| 6,718,568 | B1 | | 4/2004 | Hensley |
| 6,725,472 | B2 | | 4/2004 | Gray et al. |
| 6,757,921 | B2 | | 7/2004 | Esche |
| 6,792,629 | B2 | | 9/2004 | Nelson et al. |
| 6,807,692 | B2 | | 10/2004 | Tsutsui et al. |
| 6,868,564 | B2 | | 3/2005 | Ginter et al. |
| 6,874,527 | B2 | | 4/2005 | Meeder |
| 6,874,535 | B2 | | 4/2005 | Parsons et al. |
| 6,912,742 | B1 | | 7/2005 | Wang |
| 6,918,400 | B2 | | 7/2005 | Buchner et al. |
| 7,017,600 | B2 | | 3/2006 | Klein |
| 7,055,545 | B2 | | 6/2006 | Mascari et al. |
| 7,175,158 | B2 | | 2/2007 | Thomas |
| 2001/0011389 | A1 | | 8/2001 | Philipps-Liebich et al. |
| 2001/0044955 | A1 | | 11/2001 | Brandebusemeyer |
| 2002/0083520 | A1 | | 7/2002 | Osborne-Kirby |
| 2002/0124309 | A1 | | 9/2002 | Donath, Jr. et al. |
| 2002/0185182 | A1 | | 12/2002 | Wang |
| 2002/0189674 | A1 | | 12/2002 | Meeder |
| 2003/0204906 | A1 | | 11/2003 | Tsutsui et al. |
| 2003/0221254 | A1 | | 12/2003 | McNerney et al. |
| 2004/0034924 | A1 | | 2/2004 | Underbrink et al. |
| 2004/0060109 | A1 | | 4/2004 | Hensley |
| 2004/0094202 | A1 | | 5/2004 | Kawolics et al. |
| 2004/0123910 | A1 | | 7/2004 | Yardley |
| 2004/0143900 | A1 | | 7/2004 | Nelson et al. |
| 2004/0154673 | A1 | | 8/2004 | Mascari et al. |
| 2004/0179351 | A1 | | 9/2004 | Patterson |
| 2004/0200987 | A1 | | 10/2004 | Houghton |

| | | | |
|---|---|---|---|
| 2004/0221899 | A1 | 11/2004 | Parsons et al. |
| 2005/0022299 | A1 | 2/2005 | Brown et al. |
| 2005/0199843 | A1 | 9/2005 | Jost et al. |
| 2005/0242198 | A1 | 11/2005 | Kempf et al. |
| 2005/0242199 | A1 | 11/2005 | Kempf et al. |
| 2005/0251907 | A1 | 11/2005 | Mintz et al. |
| 2006/0076056 | A1 | 4/2006 | Schmitt et al. |
| 2006/0200904 | A1 | 9/2006 | Vogel et al. |

FOREIGN PATENT DOCUMENTS

| | | | |
|---|---|---|---|
| CN | 1278588 | | 1/2001 |
| DE | 100 22 350 | A1 | 11/2001 |
| EP | 0808952 | B1 | 9/2003 |
| GB | 371616 | | 5/1931 |
| JP | 2006/328812 | | 12/2006 |
| WO | WO 2005/056937 | | 6/2005 |
| WO | WO 2005/118966 | | 12/2005 |
| WO | WO 2006/099273 | | 9/2006 |

* cited by examiner

OVERHEAD CAM FAUCET MOUNTING SYSTEM

BACKGROUND AND SUMMARY OF THE INVENTION

The present invention relates to a mounting system for faucets in which the faucet may be mounted from the top of a mounting deck, such as a counter top or sink.

The installation of a faucet onto a mounting deck is often a difficult and time-consuming task. At least some of the installation typically requires the installer to work in the cramped and dimly lit work area under the mounting deck. More particularly, faucets are typically attached to the mounting deck with threaded connections which must be made under and behind the sink basin where there is very little room to work.

As such, there is a need to provide a less cumbersome and complicated system of installing faucets or interchanging different faucet styles onto a mounting deck which can be done largely from the top of the countertop or sink. More particularly, a system is desired which would permit the installer to exchange different escutcheon styles, delivery spouts, and handle combinations quickly and easily without replacing the complete faucet assembly and while providing an aesthetically pleasing appearance.

According to an illustrative embodiment of the present disclosure, a faucet assembly includes a mounting base configured to be coupled to a mounting deck and including first and second inlet water conduits extending downwardly away from the mounting deck. An upper faucet assembly includes a fluid coupling configured to be in fluid communication with the first and second inlet water conduits of the mounting base. A coupler is supported for rotation relative to the mounting base about a vertical axis. The coupler is releasably secured to the mounting base and to the upper faucet assembly. The mounting base cooperates with the coupler to limit rotation of the coupler to less than approximately 360 degrees.

According to a further illustrative embodiment of the present disclosure, a faucet assembly includes a mounting base configured to be coupled to a mounting deck. An upper faucet assembly is positioned above the mounting base and includes a delivery spout, a lift rod, and a lift rod passageway for receiving the lift rod. A coupler is releasably secured between the mounting base and the upper faucet assembly. At least one of the coupler and the mounting base includes an inclined ramp surface configured to cooperate with the other of the mounting base and the coupler for drawing the upper faucet assembly into a locked position relative to the mounting base. The coupler is accessible by a tool inserted through the lift rod passageway.

According to another illustrative embodiment of the present disclosure, a coupling system for use with a faucet assembly includes a cam fastener having a body, a tab extending radially outwardly from the body, and a retaining member configured to couple with an upper faucet assembly. A mounting base includes a ramp surface which is configured to guide the tab downwardly as the cam fastener rotates, such that the upper faucet assembly is drawn down into a locked position with the mounting base.

According to yet another illustrative embodiment of the present disclosure, a method of installing a faucet includes the steps of placing a mounting base on a mounting deck, and coupling the mounting base to the mounting deck from a position above the sink deck. The method further includes the steps of placing an upper faucet assembly on top of the mounting base, and engaging a coupler through a lift rod passageway formed in the upper faucet assembly. The method also includes the step of rotating the coupler about a vertical axis such that the coupler causes a downward camming of the upper faucet assembly relative to the mounting base, thereby locking the upper faucet assembly to the mounting base.

Additional features and advantages of the present invention will become apparent to those skilled in the art upon consideration of the following detailed description of the illustrative embodiment exemplifying the best mode of carrying out the invention as presently perceived.

BRIEF DESCRIPTION OF THE DRAWINGS

The detailed description of the drawings particularly refers to the accompanying figures in which:

FIG. 6 is a bottom perspective view of the mounting base of the faucet assembly of. FIG. 1 coupled to a mounting deck;

DESCRIPTION OF INVENTION

Figure 1:
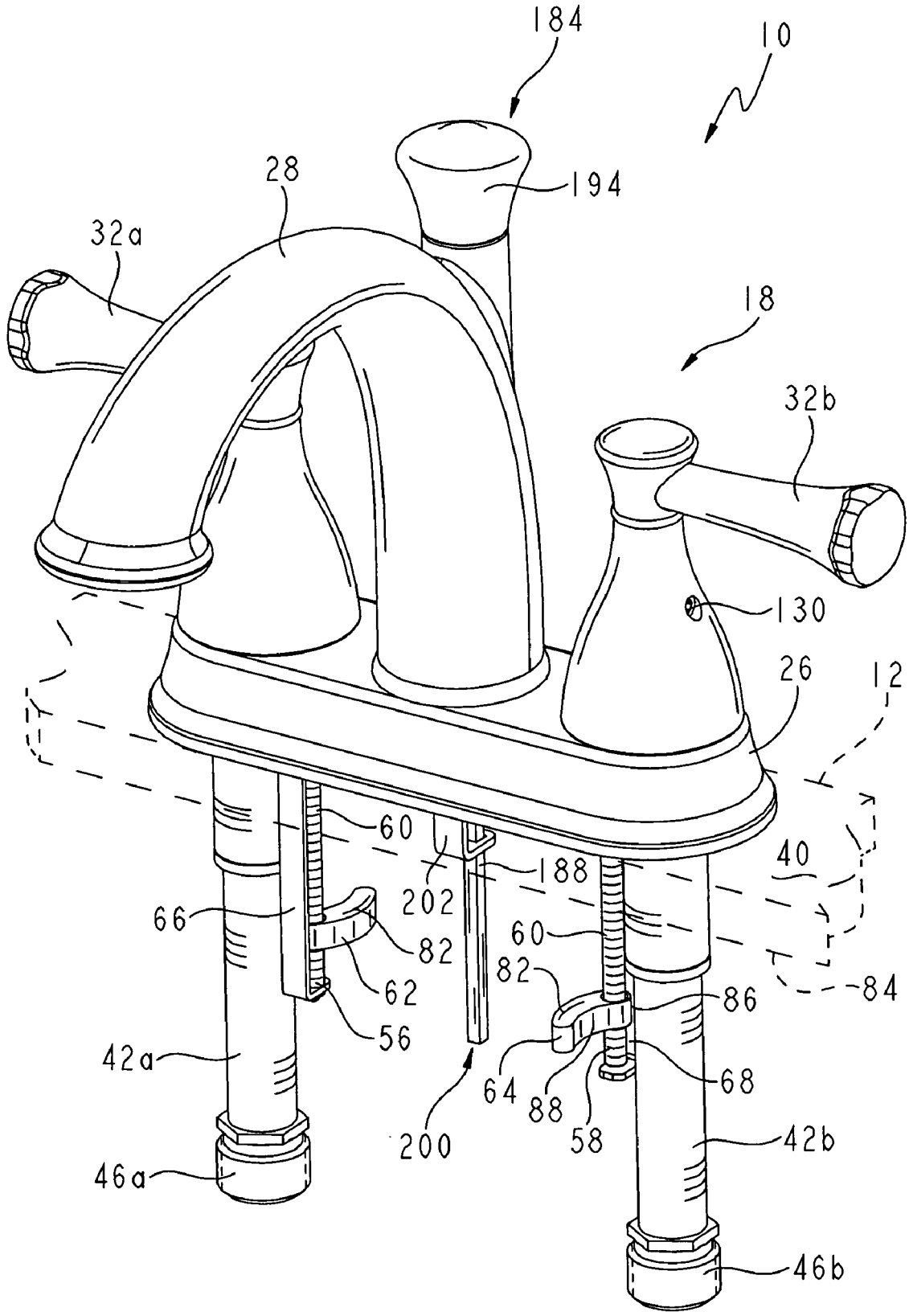
FIG. 1 is a perspective view of a two-handle faucet assembly coupled to a mounting deck and incorporating the coupling system of the present disclosure.
Figure 2:
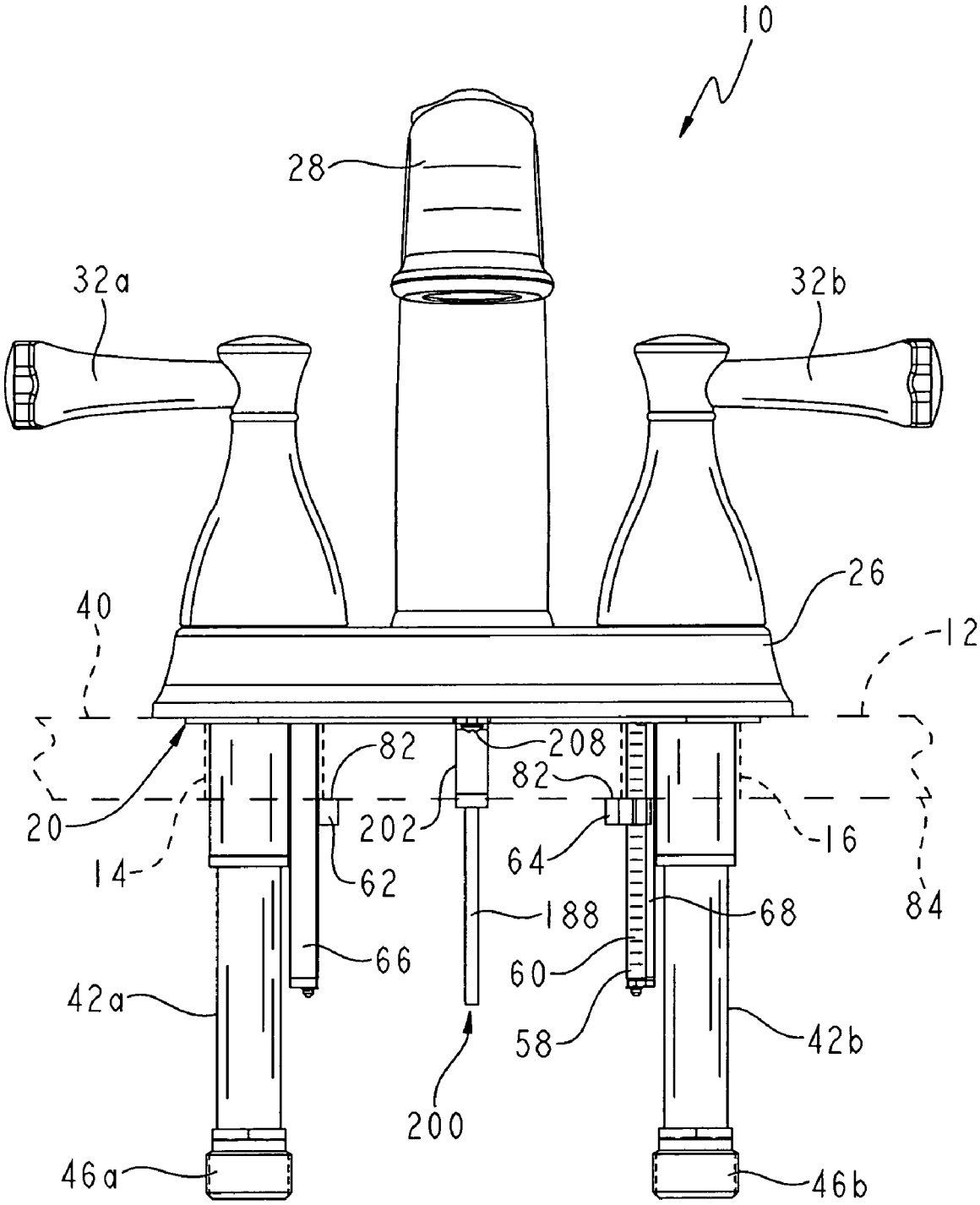
FIG. 2 is a front elevational view of the faucet assembly of FIG. 1.
Figure 3:
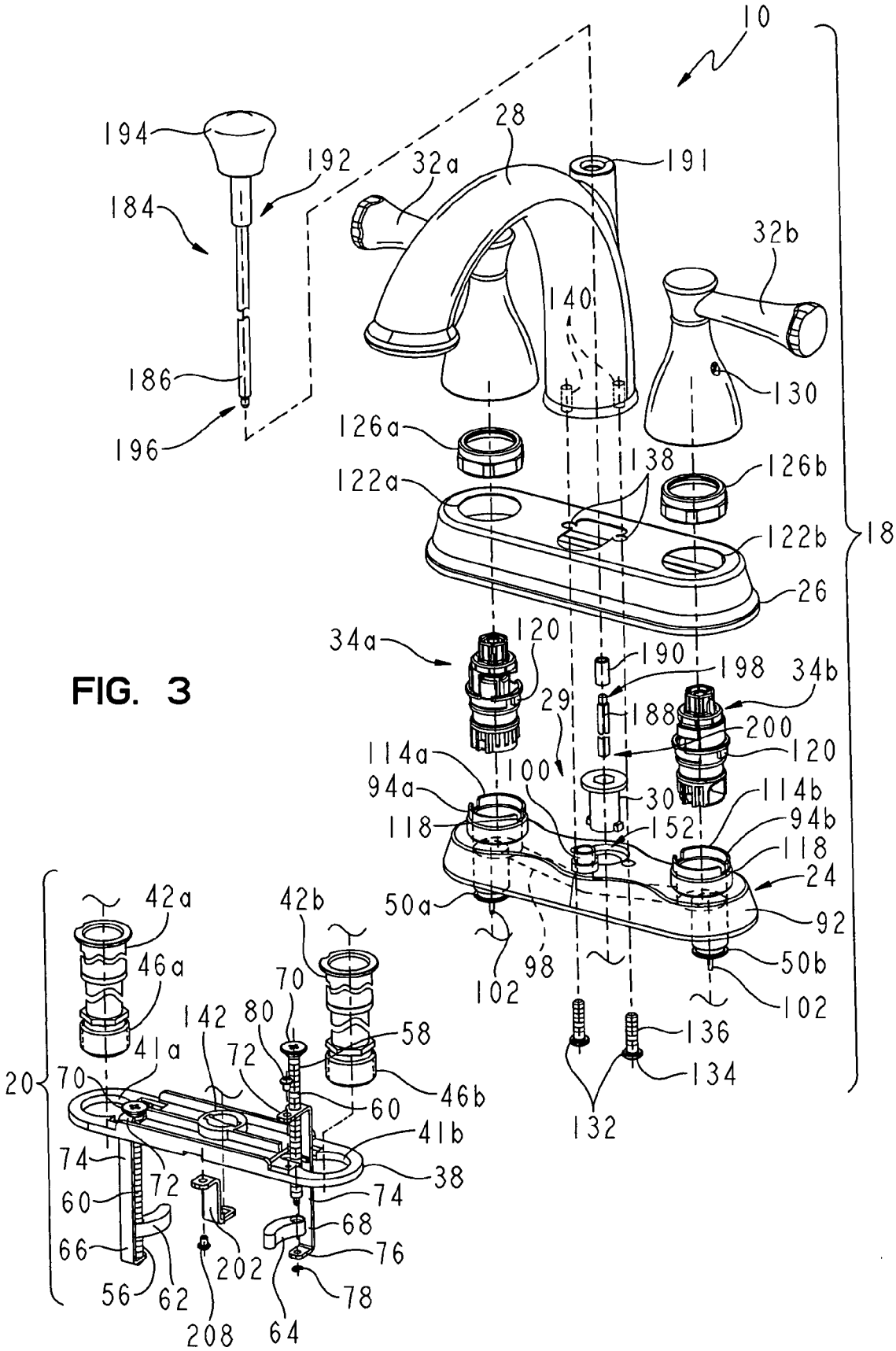
FIG. 3 is a partial exploded perspective view of the faucet assembly of FIG. 1.
Figure 6:
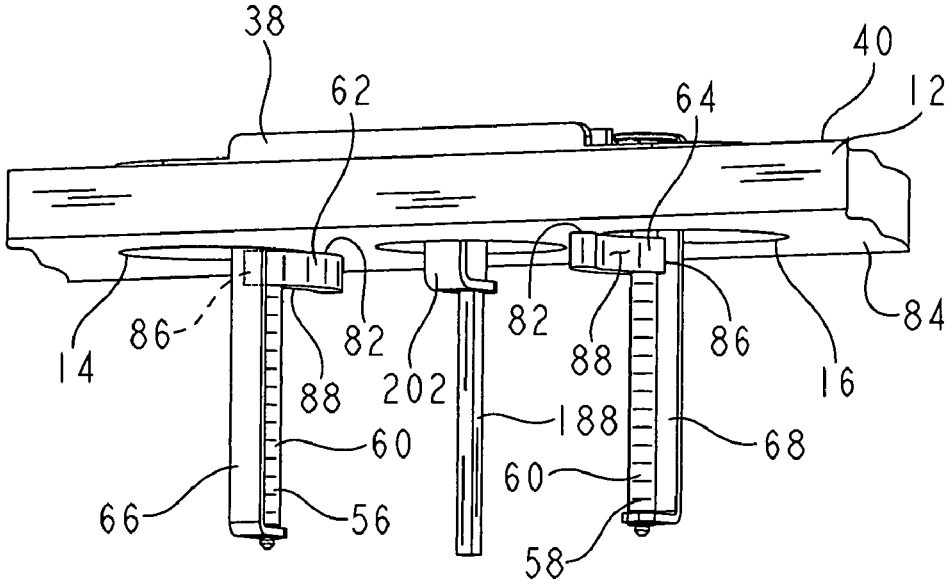
Figure 7:
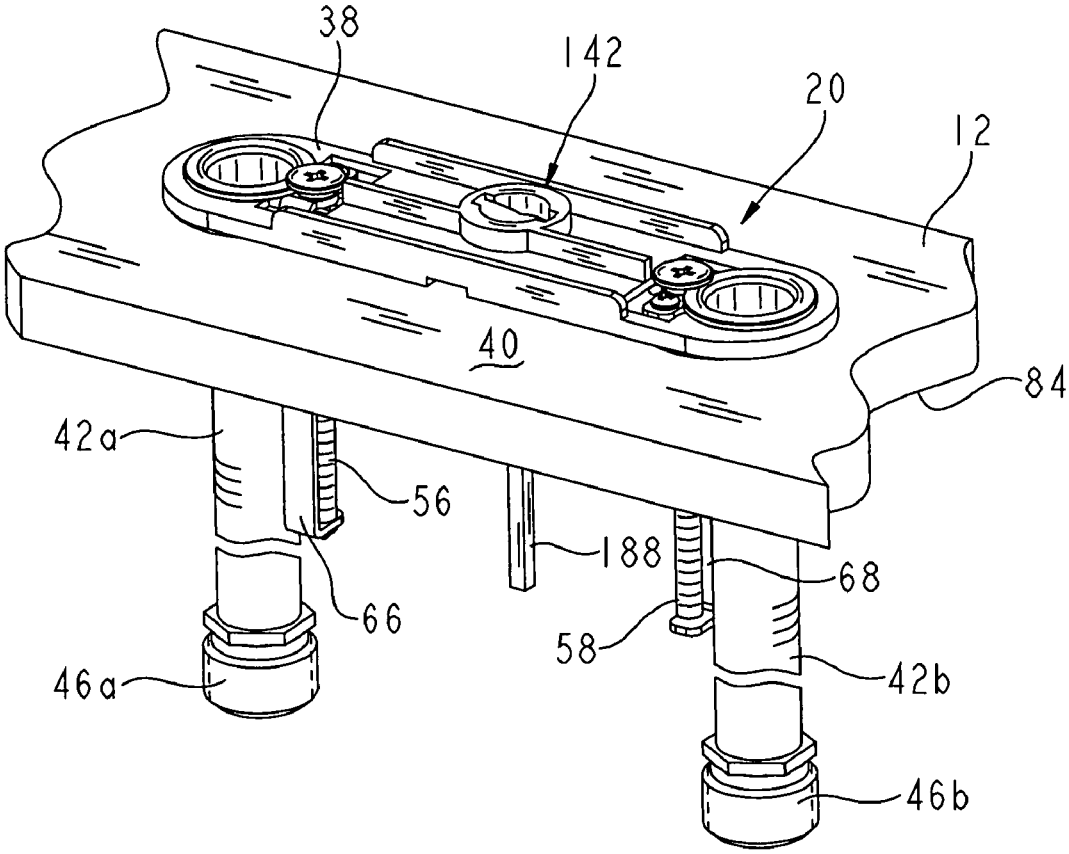
FIG. 7 is a top perspective view of the mounting base and the mounting deck of FIG. 6 showing the inlet water conduits extending downwardly therefrom.

Referring initially to FIGS. 1 and 2, a faucet assembly 10 is shown in conjunction with the mounting deck 12 on which it is mounted. The mounting deck 12 typically comprises a countertop or sink ledge and includes access openings 14, 16 (FIGS. 2 and 6). The faucet assembly 10 includes an upper faucet assembly 18 and a mounting base 20. A resilient gasket (not shown) may be positioned around the mounting base 20, intermediate the upper faucet assembly 18 and the mounting deck 12. The gasket may be used to provide compliance between the upper faucet assembly 18 and the mounting deck 12. However, other suitable compliance members, such as springs, may be substituted for the gasket. As shown in FIG. 3, the upper faucet assembly 18 includes a fluid coupling 24, an escutcheon 26, and a delivery spout 28. A coupling system 29, including a coupler 30, releasably couples the upper faucet assembly 18 to the mounting base 20.

With reference to FIG. 3, the upper faucet assembly 18 further illustratively includes first and second handles 32*a* and 32*b*, which are operably coupled to valve cartridges or assemblies 34*a* and 34*b*, respectively. More particularly, the handles 32*a* and 32*b* are supported for rotation. Rotation of the handles 32*a* and 32*b* controls the flow of hot and cold water through the valve assemblies 34*a* and 34*b*, respectively. The valve assemblies 34*a* and 34*b* may be of conventional design, and illustratively of the type detailed in U.S. Pat. Nos. 3,645,493 or 4,700,928, both of which are expressly incorporated by reference herein.

Figure 4:
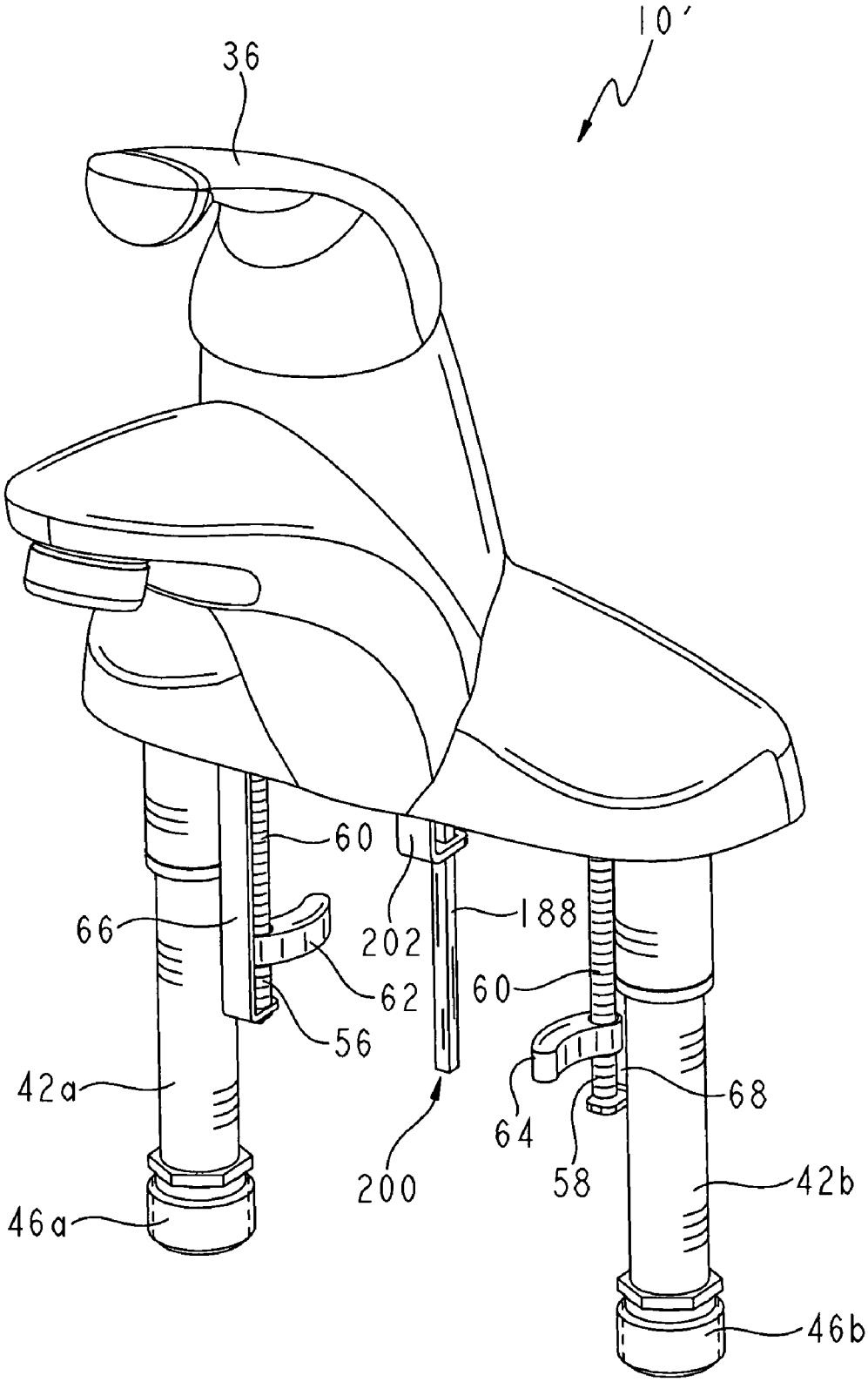
FIG. 4 is a perspective view of a single handle faucet assembly incorporating the coupling system of the present disclosure.

While the illustrative embodiment of FIGS. 1-3 shows two handles 32*a*, 32*b* coupled to a pair of valve assemblies 34*a*, 34*b*, it should be appreciated that the present invention may also be used with a faucet assembly 10' including a single handle 36, as shown in FIG. 4. In such an embodiment, the fluid coupling 24 would be modified to support a single valve (not shown) operably coupled to the handle 36. Further, while the handles 32*a* and 32*b* in the illustrative embodiment comprise levers, supported for rotation by approximately 90 degrees, it should be appreciated that conventional knobs (not shown), supported for rotation by approximately 180 degrees, may be readily substituted therefor. Moreover, levers, knobs, or any other conventional operating handle may be utilized in connection with the faucet assembly 10, 10'.

Figure 5:
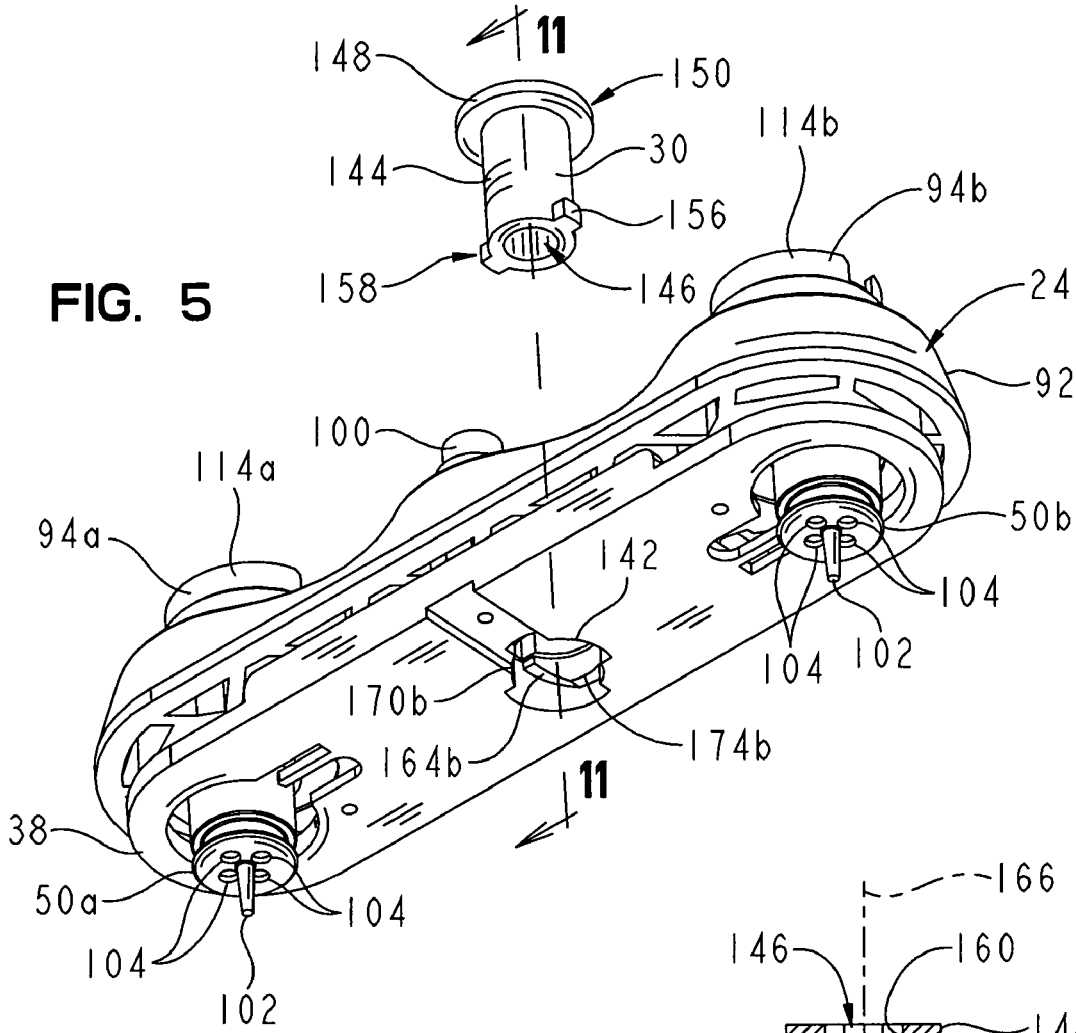
FIG. 5 is an exploded bottom perspective view of the fluid coupling, mounting support, and coupler of the faucet assembly of FIG. 1.

The mounting base 20 includes a mounting support 38 which is illustratively mounted from the top of the mounting deck 12 and sits on a top surface 40 thereof. It should be noted that the mounting base 20 may also be mounted from the underside of the mounting deck 12. Extending downwardly from openings 41*a* and 41*b* in the mounting base 20 are first and second inlet water conduits 42*a* and 42*b*. Inlet water conduits 42*a* and 42*b* pass through access openings 14 and 16 in the mounting deck 12 and are connected, through conventional fittings 46*a* and 46*b*, to conventional water supply tubes (not shown) under the mounting deck 12. Inlet water conduits 42*a* and 42*b* concentrically receive, at their upper ends, adapters 50*a* and 50*b* which extend downwardly from fluid coupling 24 (FIGS. 3 and 5). Adapters 50*a* and 50*b* carry hot and cold water from inlet water conduits 42*a* and 42*b* to valve assemblies 34*a* and 34*b*.

With further reference to FIGS. 1-3, first and second attachment posts 56 and 58 extend adjacent to and parallel with water conduits 42*a* and 42*b*. The attachment posts 56 and 58 each include a plurality of external threads 60 that are configured to operably couple with first and second mounting base locking members 62 and 64, respectively. The mounting base locking members 62 and 64 are vertically movable along the threaded attachment posts 56 and 58 that are disposed parallel with adjacent water conduits 42*a* and 42*b*, respectively. The attachment posts 56 and 58 are rotatably supported within downwardly extending brackets 66 and 68, respectively. More particularly, an upper end of each attachment post 56 and 58 includes a head 70 supported by an upper arm 72 of the bracket 66, 68 (FIG. 3). The head 70 is configured to be engaged by a tool, such as a screw driver. A connecting portion 74 of each bracket 66 and 68 extends parallel to the attachment posts 56 and 58. A lower end of each attachment post 56 and 58 is supported for rotation by a lower arm 76 and a retaining clip 78. Each bracket 66 and 68 is fixed to the mounting base 20 by a screw 80 passing through the respective upper arm 76.

To couple the mounting base 20 onto the mounting deck 12, inlet water conduits 42*a* and 42*b*, mounting base locking members 62 and 64, attachment posts 56 and 58 and brackets 66 and 68, are inserted through the access openings 14 and 16, and the mounting base 20 is lowered until it rests on the mounting deck 12.

When the mounting base 20 is on the mounting deck 12, the attachment posts 56 and 58 are rotated to cause the mounting base locking members 62 and 64 to move up or down on the posts 56 and 58. Counterclockwise rotation of the posts 56 and 58 causes locking members 62 and 64 to move downwardly or away from the mounting deck 12 to an unlocked position. Clockwise rotation of the posts 56 and 58 causes locking members 62 and 64 to move upwardly or toward the mounting deck 12 to a locked position.

In the locked position, an upper surface 82 of each locking member 62 and 64 abuts the bottom or underside 84 of mounting deck 12, thereby securing mounting base 20 to the deck 12 (FIG. 2).

With reference to FIG. 6, the locking members 62 and 64 are prevented from rotating with the attachment posts 56 and 58 as they are turned, by first and second guide surfaces 86 and 88 of the locking members 62 and 64. Guide surfaces 86 abut against brackets 66 and 68 upon clockwise rotation of the locking members 62 and 64. This causes the locking members 62 and 64 to ride up the posts 56 and 58 as these posts 56 and 58 are rotated in a clockwise direction, instead of rotating 360° along with the rotation of the posts 56 and 58. Guide surfaces 88 abut against inlet water conduits 42*a* and 42*b* upon counterclockwise rotation of the locking members 62 and 64. This causes the locking members 62 and 64 to ride down the posts 56 and 58 as these posts 56 and 58 are rotated in a counterclockwise direction.

To remove the mounting base 20 from the mounting deck 12, attachment posts 56 and 58 are turned in a counter-clockwise manner, moving the locking members 62 and 64 downwardly away from the underside of the mounting deck 12. The inlet water conduits 42*a* and 42*b*, mounting base locking members 62 and 64, attachment posts 56 and 58, and bracket 66 and 68 are then pulled up through the access openings 14 and 16 in the mounting deck 12.

In the unlocked or down position locking members 62 and 64 are swiveled against the inlet water conduits 42*a* and 42*b* and can be pulled out through access openings 14 and 16. In the up or locked position locking members 62 and 64 are swiveled away from the inlet water conduits 42*a* and 42*b* and their tops abut against the bottom surface or underside 84 of mounting deck 12. In this position the locking members 62 and 64 cannot be pulled through the access openings 14 and 16.

It is also possible that the inlet water conduits 42*a* and 42*b* may be threaded on the outer surface itself. This would then allow the mounting support to be installed in the conventional under-the-sink fashion using compatible nuts. Other known methods for under-the-sink attaching of the mounting support are envisioned as part of this invention. Examples of such additional methods are detailed in U.S. patent application Ser. No. 10/411,432, filed Apr. 10, 2003, and U.S. patent application Ser. No. 10/918,939, filed Aug. 16, 2004, both of which are expressly incorporated by reference herein.

With reference to FIGS. 3 and 5, the fluid coupling 24 illustratively includes a body 92 which supports first and second valve bodies 94*a* and 94*b* which, in turn, receive valve assemblies 34*a* and 34*b*. The fluid coupling 24 includes a waterway 98 which provides fluid communication between the adapters 50*a*, 50*b* and the chambers 94*a*, 94*b*. The waterway 98 includes an outlet 100 which is configured to fluidly couple to the delivery spout 28. In one illustrative embodiment, the valve bodies 94*a*, 94*b* and the waterway 98 are formed of a metal, such as brass, and the body 92 is formed of thermoplastic, wherein the valve bodies 94*a*, 94*b* and the waterway 98 are insert molded within the fluid coupling 24. Additional details regarding such an insert molded waterway are provided in U.S. patent application titled "Waterway Connection" Ser. No. 11/214,229 filed concurrently herewith, which is expressly incorporated by reference herein.

Figure 8:
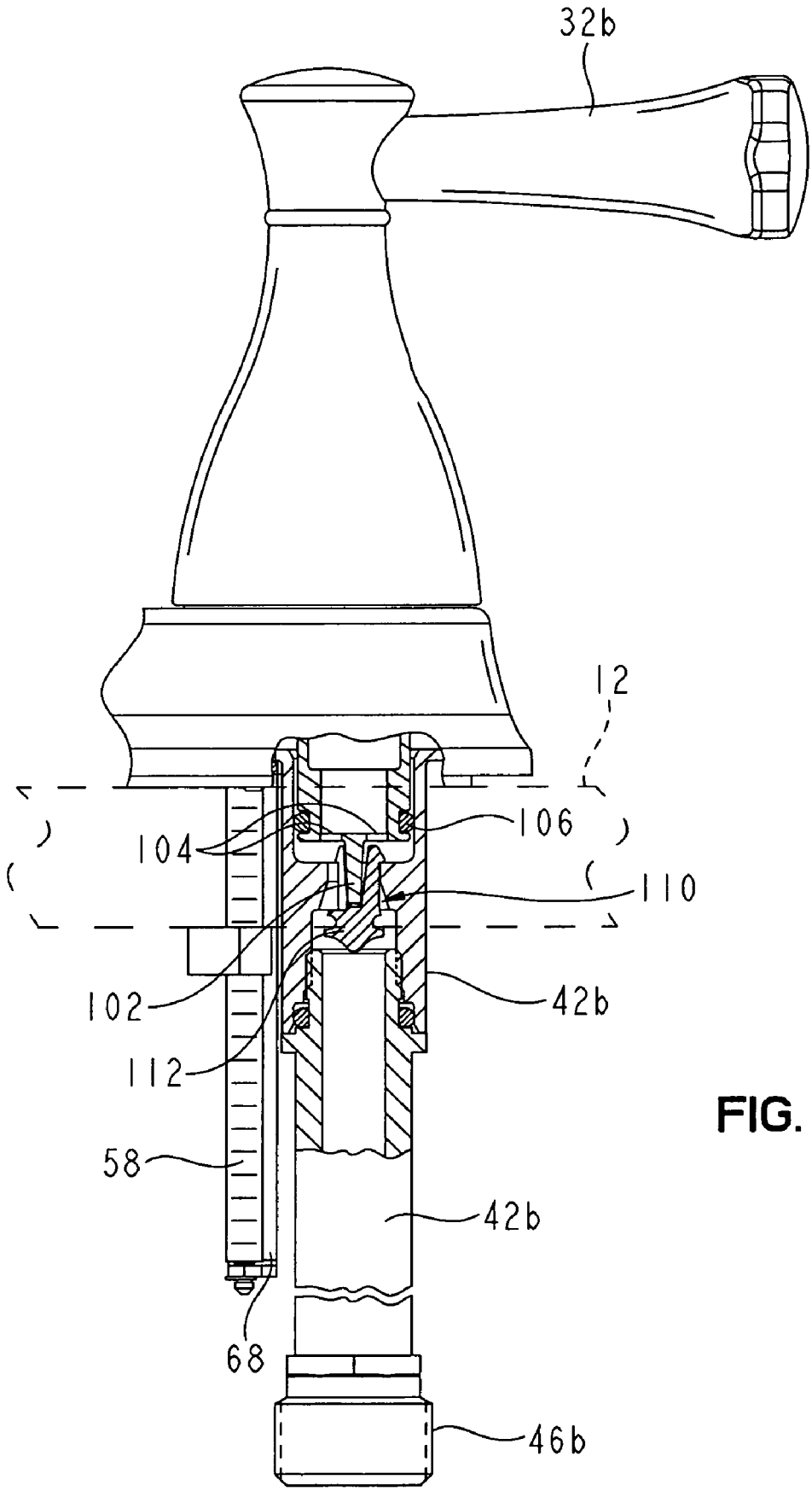
FIG. 8 is a side elevational view, in partial cross section, illustrating the engagement between an adapter of the fluid coupling and a quick release fluid connector of a fluid conduit of the mounting base.

Referring now to FIGS. 5 and 8, the adapters 50*a* and 50*b* each include a central post 102 surrounded by a plurality of fluid passageways 104. An O-ring 106 illustratively seals between each adapter 50*a*, 50*b* and the respective inlet water conduit 42*a*, 42*b*. The post 102 is configured to operably engage a quick release fluid connector 110. As such, insertion of the adapter 50*a*, 50*b* into the inlet water conduit 42*a*, 42*b* causes the post 102 to push against a sealing member 112, thereby providing fluid flow therebetween. When the adapter 50*a*, 50*b* and post 102 are removed from the inlet water conduit 42*a*, 42*b*, water pressure causes the sealing member 112 to prevent water passage therethrough. The quick release fluid connector 110 is of conventional design, and illustratively may be of the type manufactured by Damixa A/S of Odense, Denmark.

Figure 9:
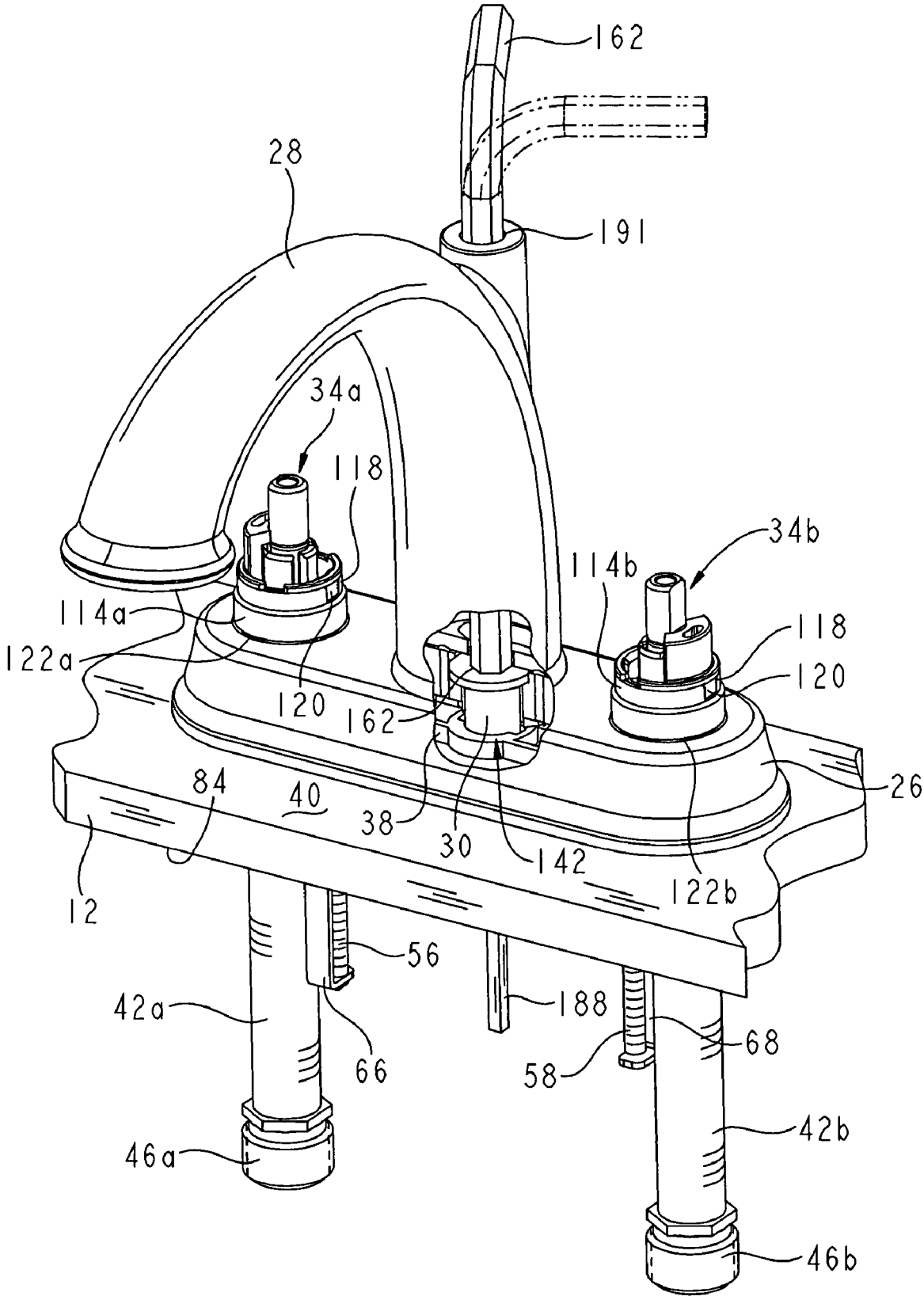
FIG. 9 is a perspective view of the faucet assembly of FIG. 1, with a partial cut-away thereof and with the upper member of the lift rod and the handles removed, showing the coupler in an unlocked position and engaged by a hex wrench.
Figure 10:
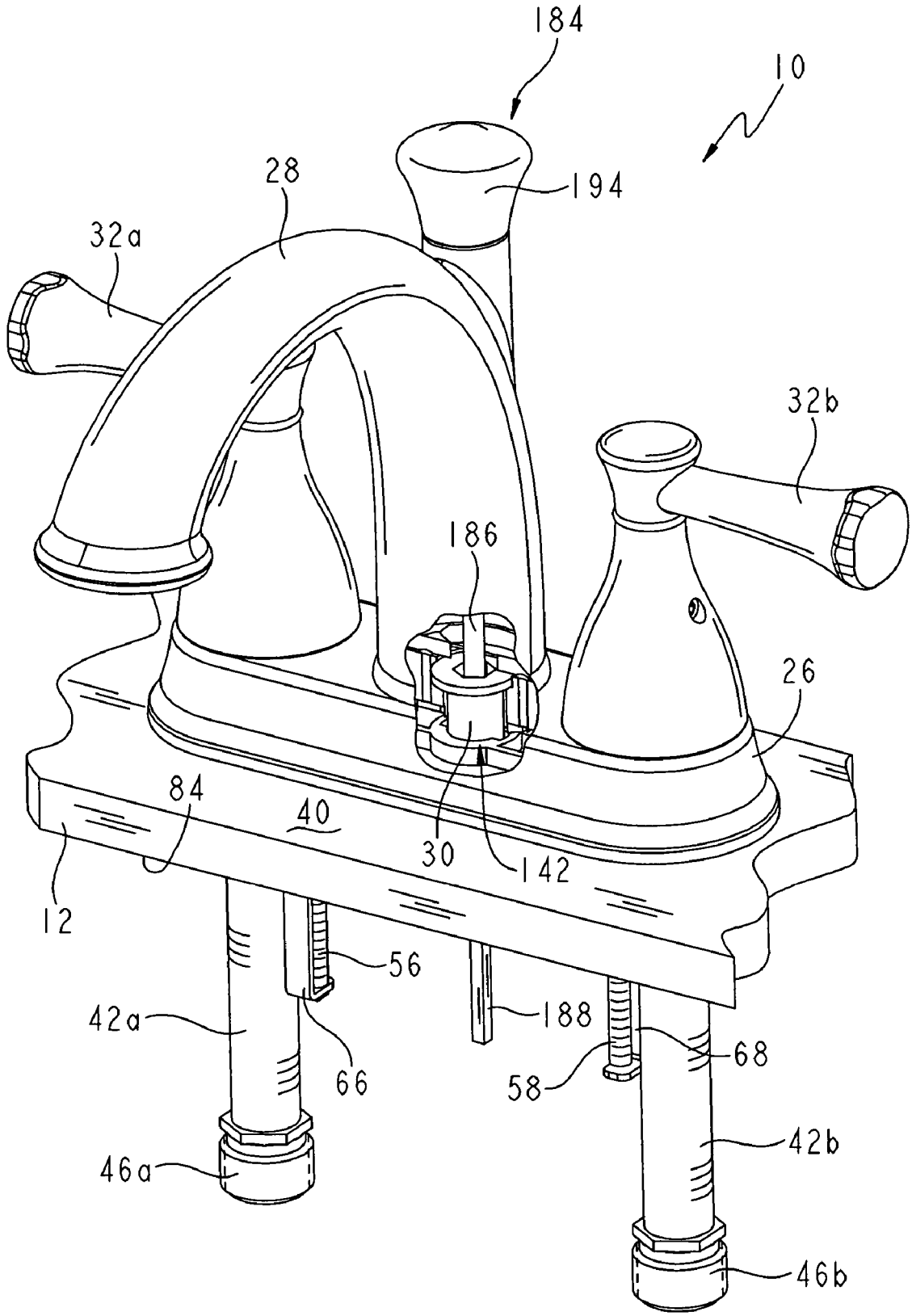
FIG. 10 is a perspective view similar to FIG. 9, with the handles supported above the escutcheon, showing the coupler in a locked position with a lift rod passing therethrough.

With reference to FIGS. 3 and 9, the valve bodies 94*a* and 94*b* include a pair of upwardly extending flanges 114*a* and 114*b* which extend upwardly and include locating notches 118 for receiving tabs 120 and thereby facilitate proper orientation of the respective valve assemblies 34*a* and 34*b*. The escutcheon 26 fits over the fluid coupling 24 such that the flanges 114*a* and 114*b* extend upwardly through openings 122*a* and 122*b* formed in the escutcheon 26. Conventional bonnet nuts 126*a* and 126*b* are threadably received on the flanges 114*a* and 114*b*, above the escutcheon 26, and secure the valve assemblies 34*a* and 34*b* within the valve bodies 94*a* and 94*b*, respectively. The handles 32*a* and 32*b* are then received over the bonnet nuts 126*a* and 126*b* and are secured in place by set screws 130 (FIG. 3).

The delivery spout 28 fluidly couples with the outlet 100 of the waterway 98 and is secured to the fluid coupling 24 by fasteners, such as screws 132. More particularly, the screws 132 have heads 134 which are retained within the body 92 of the fluid coupling 24, and threaded portions 136 which pass through clearance openings 138 in the escutcheon 26 and are threadably received within openings 140 formed in the delivery spout 28. As such, the escutcheon 26 is sandwiched between the fluid coupling 24 and the delivery spout 28.

Figure 11:
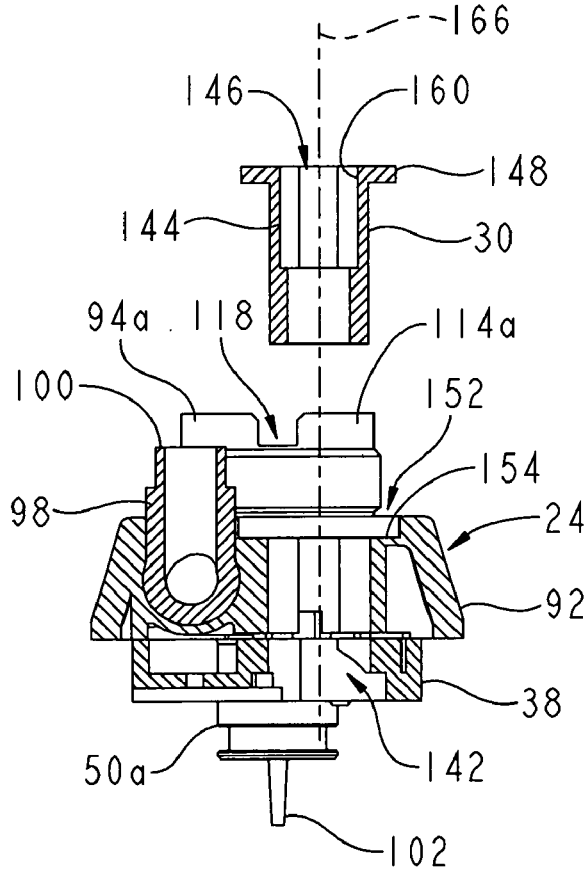
FIG. 11 is a cross-sectional view taken along line 11-11 of FIG. 5.
Figure 12:
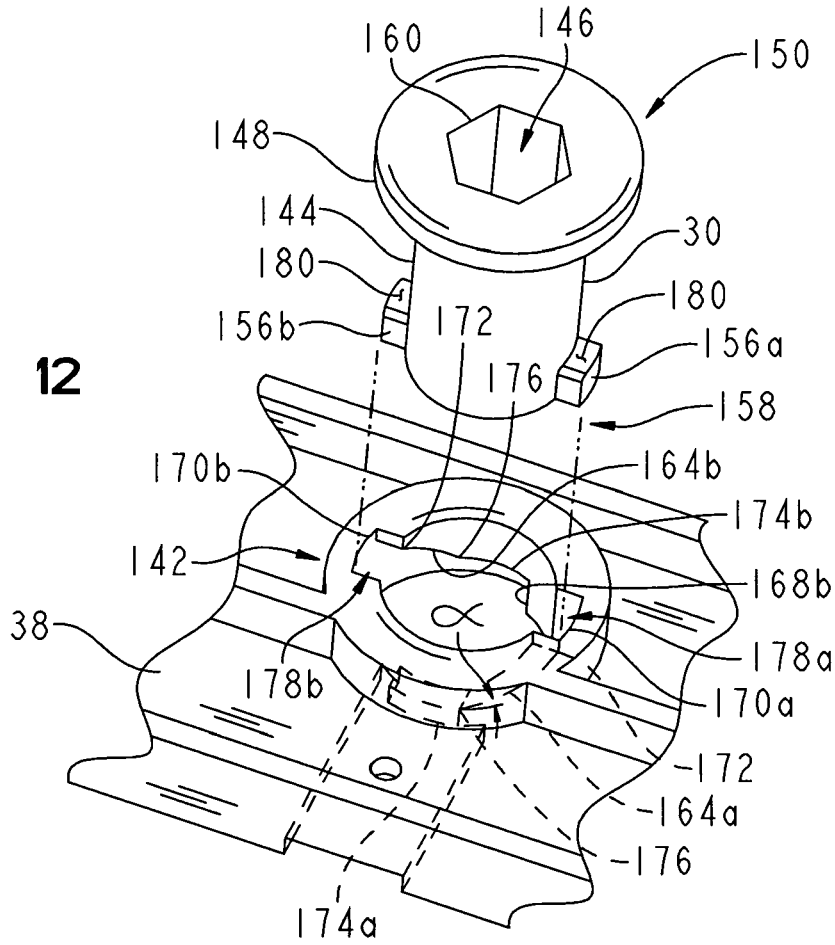
FIG. 12 is a detail perspective view illustrating the tabs of the coupler in alignment with the slots of the mounting base retainer.

With reference to FIGS. 3, 5, and 9-15, the coupling system 29 is configured to couple the upper faucet assembly 18 to the mounting base 20. More particularly, the coupler 30 of the coupling system 29 is releasably secured to the fluid coupling 24 and to a retainer 142 formed within the mounting base 20. As shown in FIGS. 5 and 12, the coupler 30 illustratively comprises a cam fastener including a cylindrical body 144 having a central passageway 146 extending longitudinally therethrough. A retainer, illustratively an annular flange 148, is supported by an upper end 150 of the body 144. The annular flange 148 is configured to be received within a counterbore 152 formed within the fluid coupling 24. More particularly, the annular flange 148 is configured to engage an annular lip 154 formed in the body 92 of the fluid coupling 24 (FIG. 11). A pair of radially outwardly extending tabs 156*a* and 156*b* are supported by a lower end 158 of the body 144. While the illustrative embodiment shows two diametrically opposed tabs 156, it should be appreciated that the number and location of the tabs 156 may be varied. The upper end 150 also includes a hexagonal shaped opening 160 configured to receive a conventional tool, such as a hex or Allen wrench 162 (FIG. 9). The upper end 150 may include other configurations to support different tools, such as a slot configured to receive the blade of a screwdriver.

Figure 13:
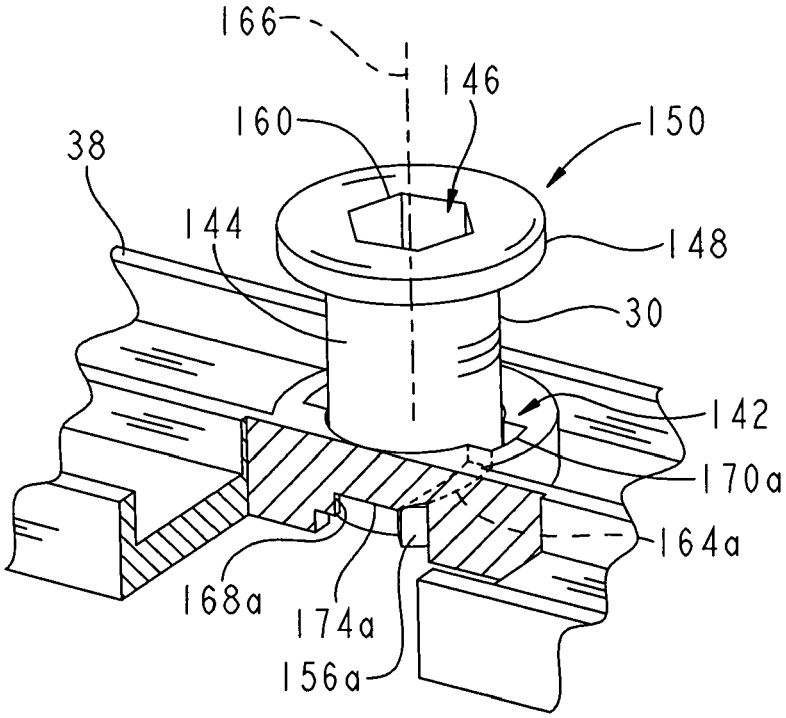
FIG. 13 is a partial perspective view with a partial cut-away thereof illustrating the tab of the coupler engaging a ramp surface of the mounting base retainer.
Figure 14:
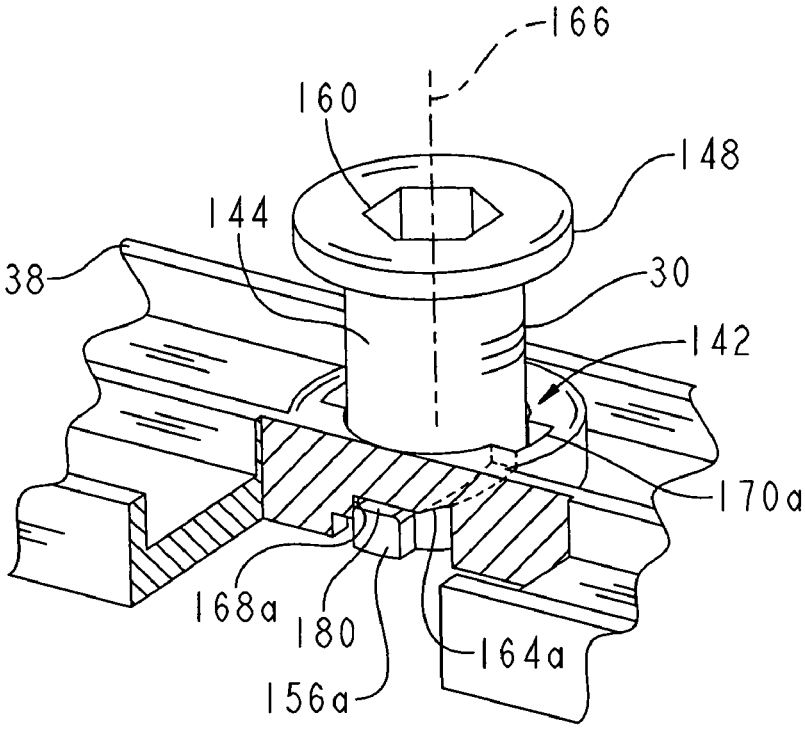
FIG. 14 is a view similar to FIG. 13 illustrating the tab of the coupler in a locked position engaging a stop.
Figure 15:
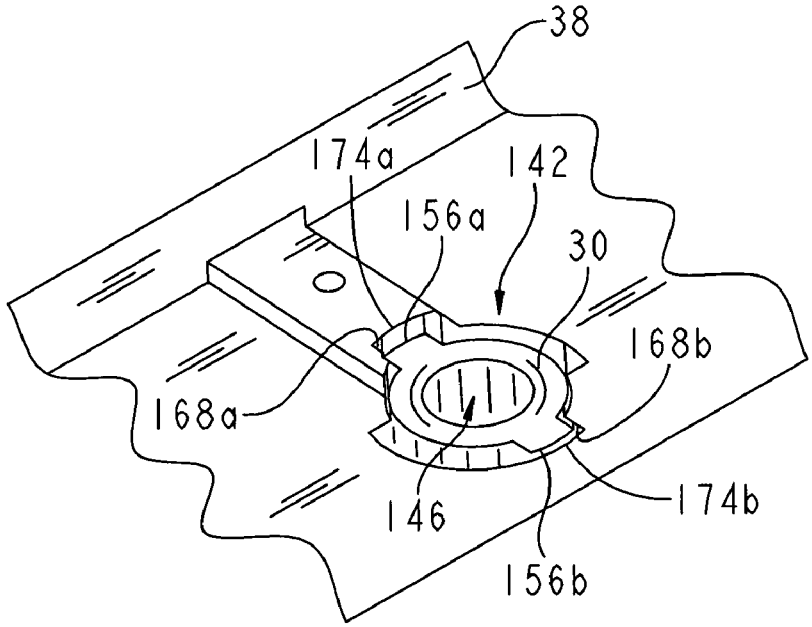
FIG. 15 is a partial bottom perspective view of the coupler in the locked position relative to the mounting base.
Figure 16:
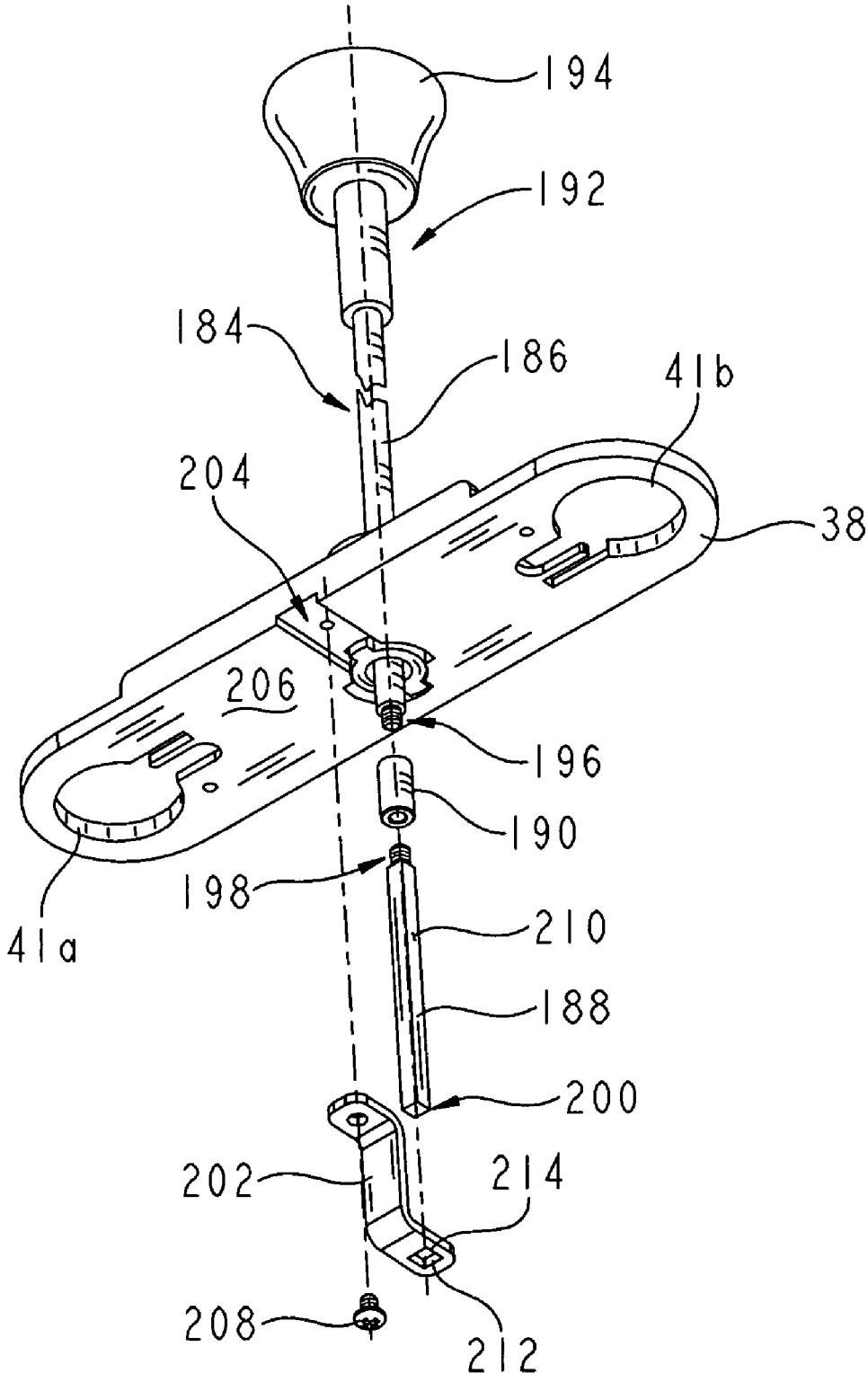
FIG. 16 is a partially exploded perspective view illustrating the lift rod passing through the coupler, which is in a locked position relative to the mounting base.

As shown in FIGS. 12-14, the retainer 142 of the mounting base 20 includes a pair of opposed inclined ramp surfaces 164*a* and 164*b* which are configured to engage and guide the tabs 156*a* and 156*b* of the coupler 30 as the coupler 30 is rotated about its longitudinal vertical axis 166. As the coupler 30 is rotated, the ramp surfaces 164 cause the body 144 to move downwardly in a camming manner. The annular flange 148 then draws the fluid coupling 24, and the remainder of the upper faucet assembly 18, downwardly. The retainer 142 of the mounting base 20 includes a pair of stops 168*a* and 168*b* which are configured to stop rotation of the coupler 30 after approximately 90° of clockwise rotation about vertical axis 166. It should be appreciated that the number and location of the stops 168 could be varied, thereby adjusting the rotational limits of the coupler 30. Moreover, the stops 168 could be located to provide rotation of the coupler 30 anywhere in the range from approximately 1 to approximately 360 degrees.

With further reference to FIGS. 12 and 13, the retainer 142 of the mounting base 20 includes entry portions 170*a* and 170*b* connected to upper ends 172 of each ramp surface 164, and terminal portions 174*a* and 174*b* connected to lower ends 176 of each ramp surface 164. The entry portions 170*a* and 170*b* illustratively include a pair of diametrically opposed slots 178*a* and 178*b* configured to slidably receive the tabs 156*a* and 156*b*, respectively, of the coupler 30. As the coupler 30 is then rotated in a clockwise direction about the vertical axis 166, an upper surface 180 of each tab 156*a* and 156*b* engages the respective ramp surface 164. As clockwise rotation of the coupler 30 continues from the upper end 172 to the lower end 176, the upper surfaces 180 of the tabs 156 ride along the ramp surfaces 164, causing the coupler 30 to cam, or move, downwardly.

In the illustrative embodiment, the ramp surface 164 is inclined downwardly from horizontal by an angle $\alpha$, which illustratively is equal to approximately 33 degrees, and permits 90 degree rotation of the coupler 30 about vertical axis 166 from the entry portion 170 to the terminal portion 176 of the retainer 142. Further, while in the illustrative embodiment, the ramp surface is helical, such that the angle $\alpha$ remains substantially constant, it should be appreciated that this angle could change along the length of the ramp surface 164 from the upper end 172 to the lower end 176. As shown in FIGS. 13 and 14, once the tabs 156 are positioned within the terminal portion 174 of the retainer 142, further clockwise rotation of the coupler 30 is prevented by stop 168.

While the illustrative embodiment shows the tabs 156 supported by the coupler 30 and the ramp surfaces 164 supported by the mounting base 20, it should be appreciated that such relative positioning may be reversed. More particularly, the tabs 156 may be supported by the mounting base 20 and the ramp surfaces 164 supported by the coupler 30. In both cases, cooperation between the tabs 156 and the ramp surfaces 164 cause the above described downwardly camming action of the upper faucet assembly 18 relative to the mounting base 20.

With reference to FIGS. 1, 3, 10, and 16, the passageway 146 of the coupler 30 is configured to receive a conventional lift rod 184. The lift rod 184 illustratively includes an upper member 186 and a lower member 188. The upper member 186 is coupled to the lower member 188 through a lift rod coupling 190 (FIGS. 3 and 16), which may be of the type detailed in U.S. patent application Ser. No. 10/928,357, filed Aug. 27, 2004, which is assigned to the assignee of the present invention and is expressly incorporated by reference herein. The upper member 186 is configured to be removably received within a lift rod passageway 191 formed within the upper faucet assembly 18, illustratively within the delivery spout 28. The upper member 186 includes an upper end 192 coupled to a conventional pull knob 194, and a threaded lower end 196 coupled to the lift rod coupling 190. The lower member 188 includes an upper threaded end 198 coupled to the lift rod coupling 190, and a lower end 200 which is operably coupled to a conventional pop-up drain assembly (not shown).

The lower member 188 passes through a bracket 202 which is coupled to a recess 204 formed in the lower surface 206 of the mounting support 38 through a screw 208. The lower member 188 has at least one flat surface 210, and is illustratively of a square cross section. The lower member 188 passes through a cooperating opening 212 formed in the bracket 202 which likewise has at least one flat surface 214, and is illustratively of a square cross section. The flat surfaces 210 and 214 of the lower member 188 and the opening 212 prevent relative rotation between the lower member 188 and the bracket 202, and hence relative rotation between the upper member 186 and the lower member 188. As such, removal of the upper member 186 from the lower member 188 is facilitated.

In order to install the upper faucet assembly 18 onto the mounting base 20, the adapters 50*a* and 50*b* of the fluid coupling 24 are aligned with the upper ends of the inlet water conduits 42*a* and 42*b*. The upper faucet assembly 18 is then lowered onto the mounting base 20, where the posts 102 of the adapters 50*a* and 50*b* engage the quick release fluid connectors 110. As such, fluid communication is provided between the inlet water conduits 42*a* and 42*b* and the waterway 98. The tabs 156 of the coupler 30 are next received within the 178 of the mounting base 20. With the upper member 186 of the lift rod 184 removed, hex wrench 162 is inserted through the lift rod passageway 191 and received within the hex opening 160 of the coupler 30. The coupler 30 is then rotated clockwise by approximately 90 degrees wherein the tabs 156 of the coupler 30 are guided along the ramp surfaces 164 from the entry portion 170 to the terminal portion 174 of the retainer 142. Engagement between the tabs 156 and the ramp surfaces 164 along the path of rotation of the coupler 30, causes camming of the upper faucet assembly 18 downwardly against the mounting base 20. The hex wrench 162 is then removed and the upper member 186 of the lift rod 184 inserted through the passageway 191 of the upper faucet assembly 18 and the passageway 146 of the coupler 30. The upper member 186 is then coupled to the lower member 188 of lift rod 184 through the lift rod coupling 190.

In order to remove the upper faucet assembly 18 from the mounting base 20, the above described process is simply reversed. More particularly, the upper member 186 of lift rod 184 is removed, and a user inserts hex wrench 162 into the lift rod passageway 191. The hex wrench 162 is received within the hex opening 160 of the coupler 30 and then rotated counterclockwise by approximately 90 degrees to release the upper faucet assembly 18 from the mounting base 20.

Although the invention has been described in detail with reference to certain preferred embodiments, variations and modifications exist within the spirit and scope of the invention as described and defined in the following claims.

The invention claimed is:

1. A faucet assembly comprising:

a mounting base configured to be coupled to a mounting deck and including first and second inlet water conduits configured to extend downwardly away from the mounting deck;

an upper faucet assembly including a fluid coupling in fluid communication with the first and second inlet water conduits of the mounting base; and a coupler supported for rotation relative to the mounting base and the upper faucet assembly about a vertical axis, the coupler releasably secured to the mounting base and to the upper faucet assembly, the mounting base cooperating with the coupler to limit rotation of the coupler to less than approximately 360 degrees.

2. The faucet assembly of claim 1, wherein the upper faucet assembly further includes a lift rod passageway, a lift rod configured to be received within the lift rod passageway, and the coupler is accessible for rotation through the lift rod passageway.

3. The faucet assembly of claim 2, wherein the coupler includes a passageway, and the lift rod is configured to pass through the passageway.

4. The faucet assembly of claim 2, further comprising a retainer supported by the mounting base and configured to restrict rotational movement of at least a portion of the lift rod.

5. The faucet assembly of claim 4, wherein the lift rod includes a lower member having at least one flat surface, and an upper member coupled to the upper member, the retainer including an aperture having at least one flat surface configured to engage the at least one flat surface of the lower member to prevent rotation thereof.

6. The faucet assembly of claim 1, wherein the mounting base includes a ramp surface, the coupler comprises a cam fastener having a radially outwardly extending tab configured to engage the ramp surface of the mounting base, and rotation of the cam fastener causes the tab to ride along the ramp surface thereby moving the upper faucet assembly relative to the mounting base.

7. The faucet assembly of claim 6, wherein the mounting base includes a stop coupled to the ramp surface and configured to prevent rotation of the coupler in excess of approximately 90 degrees.

8. The faucet assembly of claim 1, wherein the fluid coupling includes an adapter, and the mounting base includes a quick release fluid connector configured to releasably couple with the adapter of the fluid coupling.

9. The faucet assembly of claim 1, wherein the mounting base includes:

a base plate, the first and second inlet water conduits being in fluid communication with openings formed in the base plate;

a first attachment post positioned adjacent to the first fluid conduit;

a second attachment post positioned adjacent to the second fluid conduit;

a first mounting base locking member operably coupled to the first attachment post;

a second mounting base locking member operably coupled to the second attachment post; and wherein the first and second inlet water conduits are configured to be coupled to fluid supply lines for supplying fluid to the fluid coupling.

10. The faucet assembly of claim 9, wherein the first attachment post and the second attachment post each include external threads, and the mounting base locking members are threadably coupled to the attachment posts, so that as the attachment posts are rotated in a clockwise manner, the mounting base locking members move up the attachment posts until the mounting base locking members come into contact with the under surface of a mounting deck, so as to secure the mounting base to the mounting deck.

11. The faucet assembly of claim 1, wherein the coupler includes an annular flange configured to engage the upper faucet assembly.

12. The faucet assembly of claim 1, wherein the upper faucet assembly further includes a faucet body configured to fit over the fluid coupling, and a deliver spout in fluid communication with the fluid coupling.

13. A faucet assembly comprising:

a mounting base configured to be coupled to a mounting deck;

an upper faucet assembly positioned above the mounting base, the upper faucet assembly including a delivery spout, a lift rod, and a lift rod passageway for receiving the lift rod; and a coupler releasably secured between the mounting base and the upper faucet assembly, at least one of the coupler and the mounting base including an inclined ramp surface configured to cooperate with the other of the mounting base and the coupler for drawing the upper faucet assembly into a locked position relative to the mounting base, at least one of the coupler and the mounting base including a stop configured to prevent rotation of the coupler in excess of approximately 360 degrees, wherein the coupler is accessible by a tool inserted through the lift rod passageway.

14. The faucet assembly of claim 13, wherein the upper faucet assembly further includes a fluid coupling in fluid communication with the mounting base and the delivery spout.

15. The faucet assembly of claim 14, wherein the fluid coupling includes first and second adapters, and the mounting base includes first and second quick release fluid connectors configured to releasably couple with the first and second adapters of the fluid coupling.

16. The faucet assembly of claim 13, wherein the upper end of the coupler includes an opening configured to receive a hex wrench.

17. The faucet assembly of claim 13, wherein the mounting base includes the ramp surface, the coupler comprises a cam fastener having a radially outwardly extending tab configured to engage the ramp surface of the mounting base, and rotation of the cam fastener causes the tab to ride along the ramp surface thereby moving the upper faucet assembly relative to the mounting base.

18. The faucet assembly of claim 17, wherein the mounting base includes the stop coupled to the ramp surface and configured to prevent rotation of the coupler in excess of approximately 90 degrees.

19. The faucet assembly of claim 18, wherein the coupler includes a passageway, and the lift rod is configured to pass through the passageway.

20. The faucet assembly of claim 13, further comprising a retainer supported by the mounting base and configured to restrict rotational movement of at least a portion of the lift rod.

21. The faucet assembly of claim 13, wherein the coupler includes an annular flange configured to engage the upper faucet assembly.

22. A faucet assembly comprising:

a mounting base configured to be coupled to a mounting deck, wherein the mounting base includes:

a first inlet water conduit;

a second inlet water conduit;

a base plate, the first and second inlet water conduits being in fluid communication with openings formed in the base plate;

a first attachment post positioned adjacent to the first inlet water conduit;

a second attachment post positioned adjacent to the second inlet water conduit;

a first mounting base locking member operably coupled to the first attachment post;

a second mounting base locking member operably coupled to the second attachment post; and wherein the first and second inlet water conduits are configured to be coupled to fluid supply lines for supplying fluid to the fluid coupling, an upper faucet assembly positioned above the mounting base, the upper faucet assembly including a delivery spout, a lift rod, and a lift rod passageway for receiving the lift rod; and a coupler releasably secured between the mounting base and the upper faucet assembly, at least one of the coupler and the mounting base including an inclined ramp surface configured to cooperate with the other of the mounting base and the coupler for drawing the upper faucet assembly into a locked position relative to the mounting base wherein the coupler is accessible by a tool inserted through the lift rod passageway.

23. The faucet assembly of claim 22, wherein the first attachment post and the second attachment post each include external threads, and wherein the mounting base locking members are threadably coupled to the attachment posts, so that as the attachment posts are rotated in a clockwise manner, the mounting base locking members move up the attachment posts until the mounting base locking members come into contact with the under surface of a mounting deck, so as to secure the mounting base to the mounting deck.

24. A method of installing a faucet comprising the steps of:

placing a mounting base on a mounting deck;

coupling the mounting base to the mounting deck from a position above the mounting deck;

placing an upper faucet assembly on top of the mounting base;

engaging a coupler through a lift rod passageway formed in the upper faucet assembly; and rotating the coupler about a vertical axis until the coupler engages a stop such that the coupler causes a downward camming of the upper faucet assembly relative to the mounting base, thereby locking the upper faucet assembly to the mounting base, the stop preventing rotation of the coupler in excess of approximately 360 degrees.

25. The method of claim 24, wherein the rotating step includes rotating the coupler by approximately 90 degrees.

26. The method of claim 24, wherein the mounting base includes a ramp surface, and the coupler engages the ramp surface during the rotating step.

27. The method of claim 24, wherein the step of placing the upper faucet assembly on top of the mounting base includes inserting adapters into quick release fluid connectors.

28. The method of claim 24, wherein the step of engaging the coupler includes inserting a tool into the upper end of the coupler.

* * * * *